United States Patent [19]

Jensen et al.

[11] 4,120,713

[45] Oct. 17, 1978

[54] PROCESS AND APPARATUS FOR THE CONTINUOUS PRODUCTION OF A FIBROUS WEB-LIKE PILE PRODUCT

[75] Inventors: Finn Ulrik Hansen Jensen, Skanderborg; Per Drengsgaard Nielsen, Braedstrup; Esben Bruhn, Hov, all of Denmark

[73] Assignee: A/S Weston Taeppefabrik, Denmark

[21] Appl. No.: 806,371

[22] Filed: Jun. 14, 1977

[30] Foreign Application Priority Data

Jun. 21, 1976 [DK] Denmark ..... 2781/76

[51] Int. Cl.[2] ..... B32B 31/18

[52] U.S. Cl. ..... 156/72; 156/265; 156/272; 156/285; 156/435; 156/519

[58] Field of Search ..... 156/72, 435, 272, 380, 156/264, 519, 765, 276, 68, 285; 28/159, 162, 282, 283, 104; 19/657, 144; 68/5 R, 5 A–5 C, 222; 348/362, 363; 427/25, 76, 194; 26/2 R, 2 E

[56] References Cited

U.S. PATENT DOCUMENTS

| | | | |
|---|---|---|---|
| 2,082,182 | 6/1937 | Schacht | 427/26 |
| 2,998,051 | 8/1961 | Sittel | 19/144 |
| 3,286,307 | 11/1966 | Watson | 28/283 |
| 3,328,850 | 7/1967 | Watson | 28/282 |
| 3,574,261 | 4/1971 | Bailey | 34/23 |
| 3,575,751 | 4/1971 | Mizell | 156/68 |
| 3,615,967 | 10/1971 | Steblen | 156/72 |
| 3,772,108 | 11/1973 | Lezher et al. | 156/68 |
| 3,778,144 | 12/1973 | Hudson | 118/637 |
| 3,839,114 | 10/1974 | Schmidt et al. | 156/72 |
| 3,850,713 | 11/1974 | Hurtes | 156/72 |
| 3,959,059 | 5/1976 | Alexander et al. | 156/276 |
| 4,017,345 | 4/1977 | Bruhn et al. | 156/72 |

*Primary Examiner*—Douglas J. Drummond
*Assistant Examiner*—Michael W. Ball
*Attorney, Agent, or Firm*—Watson, Cole, Grindle & Watson

[57] ABSTRACT

A web-like fibrous material consisting of fibres standing on end is produced from a starting material consisting of a web-like fibrous material, in which the fibres are oriented substantially transversely or longitudinally of the web. The starting material is cut into strips which in well-known manner are arranged side by side with the fibres standing on end. It is the object of the invention to eliminate the spaces or interfaces between these strips in a more efficient manner than has hitherto been possible. To this end, the side-by-side pattern of strips is deposited on a moving intermediary supporting surface, on which they are retained by an attractive force directed towards said surface and are at the same time subjected to a spreading action transversly of the strips, whereafter the fibres are deposited at a second depositing position on a moving product receiving surface while at the same time interrupting the attractive force acting on the fibres being deposited.

The attractive and spreading forces may particularly be produced by suction of air through perforations of the intermediary supporting surface and/or by electrostatically charging that surface.

9 Claims, 17 Drawing Figures

PROCESS AND APPARATUS FOR THE CONTINUOUS PRODUCTION OF A FIBROUS WEB-LIKE PILE PRODUCT

BACKGROUND OF THE INVENTION

The invention relates to a process for the continuous production of a fibrous web-like pile product consisting of fibres oriented substantially at right angles to the two main surfaces of the web, starting from a primmary fibrous web in which the fibres are oriented substantially along the main surfaces of the web transversely or longitudinally of the web, comprising the steps of cutting the primary web into strips consisting of cut-off fibres, arranging the strips side by side with the cut-off fibres standing on end and conveying them in this side-by-side relationship to a first depositing position. Where starting from a primary fibrous web having transversely oriented fibres, the step of arranging the strips as indicated involves the turning of each strip through an angle of 90° about its longitudinal axis.

The U.S. Pat. specification No. 3,493,452 discloses such a process, in which the cut-off strips are conveyed between pairs of conveyor belts of the same width as the height of the strips. The pairs of conveyor belts after having been twisted through an angle of 90° deliver the strips between two conveyor belts extending throughout the width of the web formed by the strips, and these will now have a tendency to expand towards one another and thereby to eliminate the spaces between the strips, and if this tendency is strong enough the strips will eventually form a homogeneous batt of fibres standing on end. It will be appreciated, however, that in this expansion stage the fibres are not completely under control and the product may therefore not always be as uniform as desirable.

The U.S. Pat. specification No. 4,017,345 discloses a process for producing a similar pile product, in which process the cut-off strips are conveyed between pairs of conveying wires which have line contact only with the strips so that the free fibre ends before being deposited on a pile receiving surface will have a natural tendency to spread and therefore to be deposited in a homogeneous pattern. The fibre ends extending away from the pile receiving surface will at first form a less uniform pattern, but these may subsequently be subjected to treatment tending to distribute them uniformly over the whole area of the product so that there will no longer be any visible interfaces of the strips, and at any rate these interfaces will disappear when the product is used e.g. in the form of a pile carpet.

SUMMARY OF THE INVENTION

According to the present invention, the strips after having been cut, arranged side by side as indicated and conveyed to the first depositing position, e.g. as in either of the known processes referred to or in any other manner, are deposited on a moving intermediary supporting surface, on which they are retained by an attractive force directed towards said surface and are at the same time subjected to a spreading action transversely of the strips, whereafter the fibres are deposited at a second depositing position on a moving product receiving surface while at the same time interrupting the attractive force acting on the fibres being deposited. Thereby a product of more controlled uniformity can be obtained than in either of the processes described, because the strips are firmly retained to the intermediary supporting surface by the said attractive force, while being subjected to said spreading action effacing the spaces between the strips and remain firmly retained on the intermediary supporting surface until deposited on the product receiving surface. This product receiving surface may be an adhesive backing, to which the fibres are caused to adhere when the attractive force is interrupted in the second depositing position. It has been found, however, that the product receiving surface need not be adhesive, but may be a non-adhesive conveying member on which the pile material may slide away or be carried away as a coherent web of fibrous material.

The attractive force directed towards the intermediary supporting surface may advantageously be created at least in part by means of a vacuum which through perforations of the surface at a low pressure drop is conveyed to the side of the intermediary supporting surface facing the strips. In that case the strips are retained on the intermediary supporting surface by a flow of air rapidly flowing from the surroundings towards the intermediary supporting surface, and since the velocity of the air flow will be higher in the spaces between the strips where there are no fibres to slow down the flow a lower pressure will prevail in these spaces which in conjunction with the higher pressure within the bodies of the strips subjects the fibres to a spreading action which does not cease until the spaces have been filled with fibres.

The spreading effect of the flow of air on the fibres may be further promoted by conducting air from the surroundings to the perforations of the intermediary supporting surface through the strips via slots of a screen arranged immediately outside the outermost fibre ends. This is particularly important if the strips contain many transversely directed fibres or if the fibres are not completely parallel. Preferably the slots are so arranged that a substantial part of the air drawn through same is caused to flow into the bodies of the strips and to be deflected therein towards the strip edges from where it is drawn through the perforations of the intermediate supporting surface. In this manner a higher positive pressure is produced in the bodies of the strips, while a lower negative pressure will prevail in the spaces between the strips where these are covered by the solid portions of the screen between the slots.

In an alternative embodiment the attractive force towards the intermediate supporting surface is at least in part produced by charging the surface of same, the latter being in that case made of an electrostatically chargeable material, to a potential exerting a retaining force on the strips and charging the fibres up to a mutual repulsive force sufficient to spread uniformly at least the outermost fibre ends throughout the extension of the web formed by the strips. This type of attractive force is particularly suitable for treating a fiber material where the majority of fibres are non-metallic.

The potential to which the intermediary supporting surface is charged should preferably be sufficient to charge the fibres up to a mutual repulsive force sufficient to overcome the frictional force between the intermediary supporting surface and the innermost fibre ends retained thereon whereby also these ends are spread uniformly throughout the extension of the web formed by the strips. This will completely eliminate the necessity for any subsequent treatment of the fibre ends extending away from the product receiving surface. Upon completion of the electrostatic action on the web formed by the strips, this may be released from the intermediary supporting surface simply by locally discharging the intermediary supporting surface throughout the width of the web formed by the strips at the position of deposition of the fibres on the product receiving surface. The fibre product may then drop by its own weight from the intermediary supporting surface to the product receiving surface. A dropping height of the order of 1 mm will usually suffice, and the product receiving surface need not exercise any force to remove the fibre product from the intermediary supporting surface. The discharge of the intermediary supporting surface may be effected by exposing it to an ionized atmosphere or by rendering it conductive to enable the electrostatic charge to be removed from the fibres.

After discharge of the intermediary supporting surface, this may advantageously be charged in the same position to a potential of opposite polarity to that of the original potential, whereby the fibre product, which is now homogeneous, need not drop by its own weight to leave the intermediary supporting surface, but may be electrically repulsed. In that case the product receiving surface need not be horizontal, but could also be vertical and travel upwards or downwards.

The invention also relates to an apparatus for the continuous production of a fibrous web-like pile product consisting of fibres oriented substantially at right angles to the two main surfaces of the web, starting from a primary fibrous web in which the fibres are oriented substantially along the main surfaces of the web transversely or longitudinally of the web, said apparatus comprising means for cutting the primary web into strips consisting of cut-off fibres, arranging the strips side by side with the cut-off fibres standing on end, and conveying them in this side-by-side relationship to a first depositing position. According to the invention, in order to carry out the process above described, the apparatus comprises a movable element constituting an intermediate supporting surface arranged to receive said strips in said first depositing position and to convey them to a second depositing position for deposition on a moving product receiving surface, means active between said first and second depositing positions for producing an attractive force acting on the strips in a direction towards said intermediate supporting surface to retain the strips thereon and for subjecting the fibres of the strips to a spreading action directed towards the spaces between the strips.

The intermediary supporting surface may advantageously be in communication, throughout its width and over the part of its length between the first and the second deposition positions, with a vacuum chamber provided behind the intermediary supporting surface via a plurality of openings extending through the supporting surface over its entire area, which openings are sufficiently small to prevent the fibres from being sucked therethrough and sufficient in number to enable the fibres to be retained on the supporting surface by means of the air flow sucked in at a low pressure drop through the openings. It will be realized that in this embodiment the attractive force is established by means of a vacuum retaining the web during its travel from the first depositing position to the second depositing position and as a result of the stronger flow of air through the spaces between the strips than through the strips themselves the fibres are subjected to a sucking effect directed towards said spaces.

In order to further promote the spreading of the fibres transversely of the strips the apparatus may advantageously comprise a screen mounted at a distance from the intermediary supporting surface and having air passage slots arranged with equal spacing transversely of the strips, the distance of said screen from the intermediary supporting surface being preferably less than 10% greater than the thickness of the strips. At the places where the solid portions between the slots overlie the spaces between the strips the flow of air sucked in through the adjacent slots will be subjected to a deflection which increases the fibre spreading effect.

In a preferred embodiment, the slots are inclined relatively to the longitudinal direction of the strips, each slot covering more than one fibre strip on the intermediary supporting surface, at least part of each slot together with at least part of an adjacent slot covering a common area of the width of the web formed by the strips. Thereby the positions, the size and the spacing of the slots become relatively independent of the location and mutual distance of the spaces between the strips.

The screen may advantageously comprise two overlapping, closely spaced, relatively movable parts, each provided with slots capable of being aligned with the slots of the other part to provide a full flow area and of being displaced relatively to the slots of the other part to reduce the flow area and possibly at the same time to increase the spacing between the slots of the screen. In this manner it becomes possible to control both the total air flow through the fibre material and the spreading action in accordance with the needs in any particular case.

The intermediary supporting surface may be cylindrical and may be rotatably mounted on a stationary hollow shaft provided with sealing lips in positions corresponding to the first annd second depositing positions and having openings for producing a vacuum along the portion of the supporting surface at any time travelling from the first to the second depositing position.

As an alternative or supplement to the attractive force and spreading air flow system so far described the apparatus may comprise means for electrostatically charging the portion of the intermediary supporting surface at any time travelling from the first to the second depositing position to a potential subjecting the fibres to an attractive force towards said surface and to mutually repulsive forces. In some cases the electrostatic charge of the intermediary supporting surface may be sufficient to firmly retain the fibres in a position at right angles to the intermediary supporting surface, while in other cases it may be preferable to produce the attractive force acting on the strips by the combination of an electrostatic charge and a vacuum. The electrostatic force will further contribute to spreading the fibres so as to eliminate the spaces between the strips.

Where the electrostatic arrangement is used, the supporting surface may be of an electrically insulating material adapted after having been charged to be discharged by an ionized atmosphere or by the action of light rendering the surface conductive, means being provided for charging the intermediary supporting surface adjacent the first depositing position and for discharging the supporting surface adjacent the second depositing position.

Preferably the supporting surface is sufficiently smooth to allow easy displacement of the innermost fibre ends towards the spaces between the strips, whereby complete uniformity of the fibre material may be obtained without any additional treatment.

Where reference is made in the beforegoing or the following description to "a fibrous web-like pile product", this is to be understood as a product consisting of uniformly oriented fibres extending at right angles to the main surface of the web. Examples of fibres which may be used in such a product are pieces of filaments, yarns, threads or straw as well as glass wool or rock wool fibres.

DESCRIPTION OF THE PREFERRED EMBODIMENTS

Figures 1A, 1B, 2, 3:
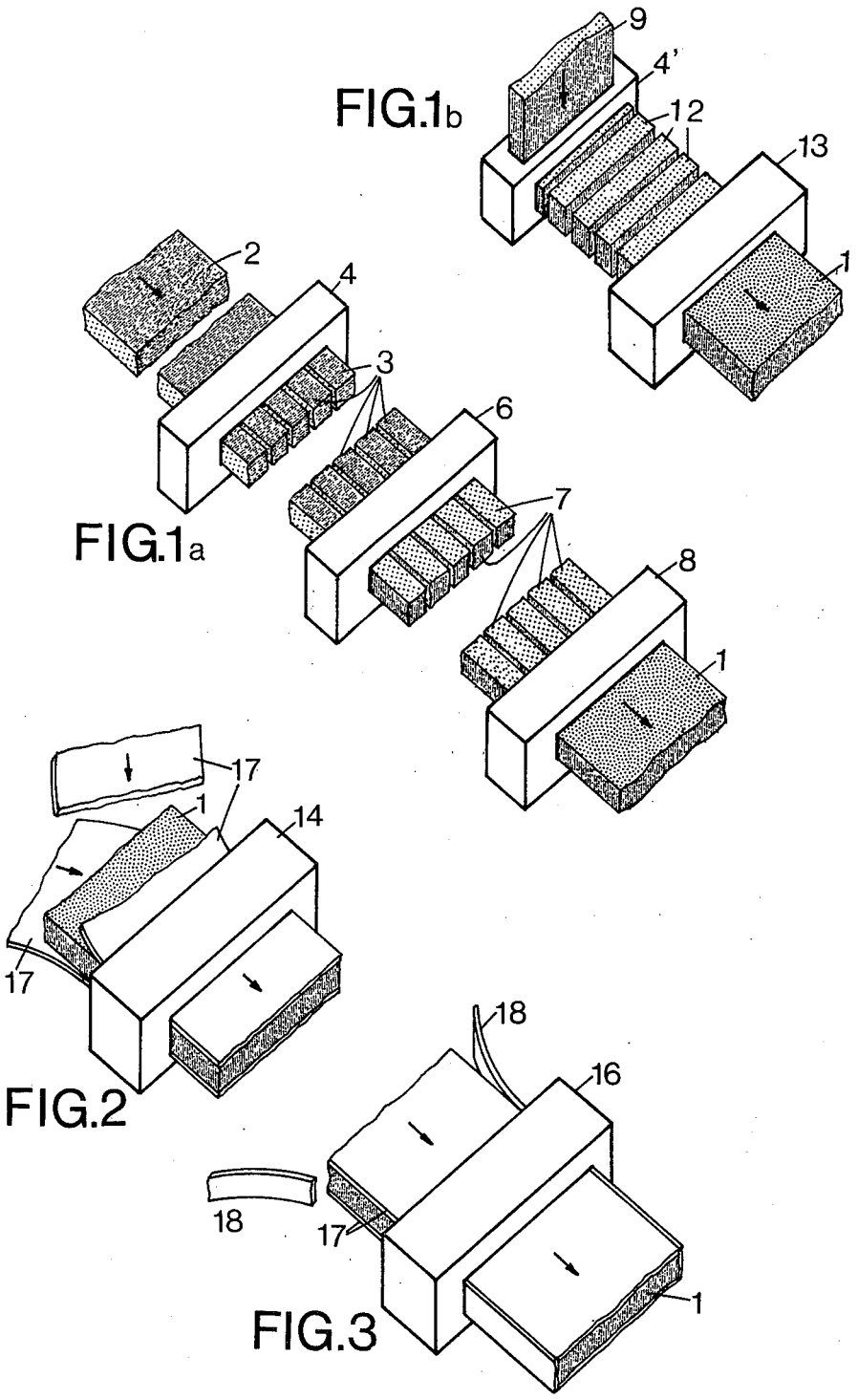
FIG. 1*a* is block diagram illustrating the main steps of the process according to the invention, when using a starting material with transversely oriented fibres.
FIG. 1*b* is a similar diagram illustrating the process when using a starting material with longitudinally oriented fibres.
FIG. 2 illustrates a subsequent processing step, where cover sheets or plates are applied to the main surfaces of the web-like fibrous product.
FIG. 3 illustrates a further processing step where also the edges of the web-like fibrous product are covered with sheet or plate material.

FIG. 1*a* is a schematic illustration of a process for the continuous production of a web 1 of fibrous material in which the fibres are at right angles to the main surfaces of the web 1, starting from a primary web 2 of fibre material in which the fibres are oriented substantially along the surfaces of the web transversely of the longitudinal direction of the web. By cuts at right angles to the web 2 the latter is divided into a plurality of strips 3 of equal width, containing cut-off fibres, which strips 3 are then individually turned 90° about their longitudinal axes and placed side by side to form the web 1 of fibrous material with the fibres at right angles to the main surfaces of the web which are constituted by the ends of the cut-off fibres. The web 2 is cut into strips 3 in a cutting unit 4, and the strips 3 are turned 90° about their longitudinal axes in a turning unit 6, from which the turned strips 7 emerge with their fibres at right angles to the main surfaces of the web. The strips 7 then pass through a processing unit 8 in which the spaces between the strips 7 are eliminated by subjecting the fibres of the strips to a spreading action transversely of the strips to form the web of material 1, which exhibits homogeneous surfaces constituted by the fibre ends.

FIG. 1*b* shows how the web 1 of fibrous material 1 is made from a web 9 of fibrous material, where the fibres extend lengthwise of the longitudinal dimension of the web, and where the cutting takes place in a cutting unit 4' delivering the cut-up fibrous material in the form of strips 12 arranged in juxtaposed relationship with spaces transversely of their travelling direction to a processing unit 13 which eliminates the spaces to form the homogeneous web of fibrous material 1.

The homogeneous web of fibrous material 1 may then be deposited on a conveyor band and passed on to subsequent operations or it may be directly deposited on a backing provided with an adhesive, e.g. to form a pile carpet.

By means of a sheet facing device 14 the homogeneous web 1 may also, as shown in FIG. 2, have its main surfaces covered with sheet material 17 and, as shown in FIG. 3, have its side edges covered with sheet material 18 depending on the intended use of the web. As an example, the composite material thus formed may be used as a sound insulating material. The sheet material 17 may also serve as carpet backings to which the main surfaces of the web 1 are fixed by adhesion or fusion, and after the composite material thus formed has left the sheet facing device 14, the homogeneous web 1 may then be sliced up to provide two pile carpets.

Figure 4:
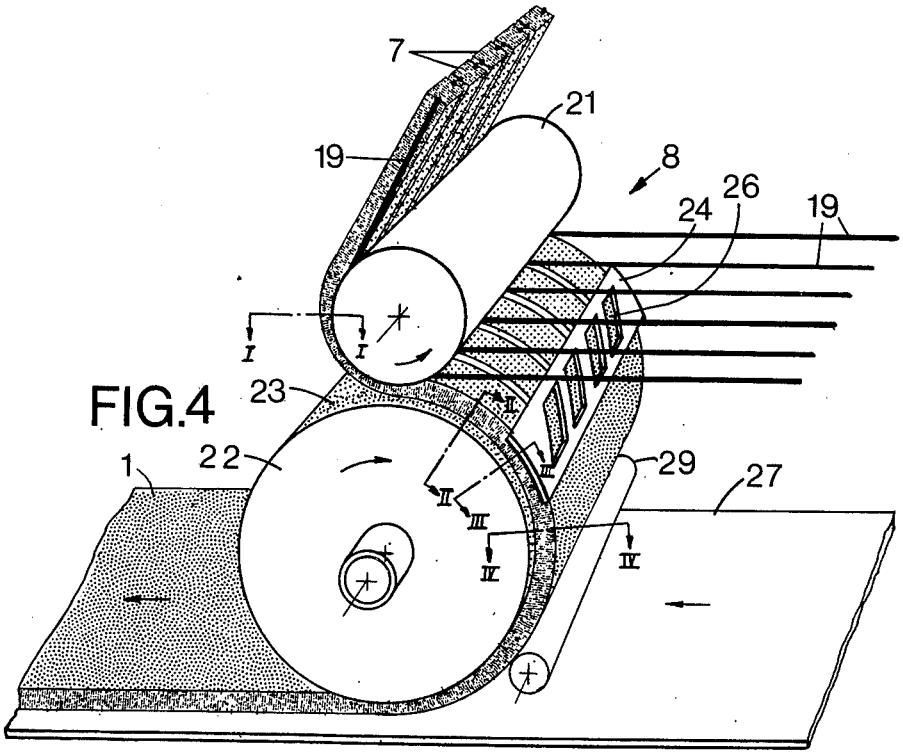
FIG. 4 is a perspective diagrammatic view of an apparatus according to one embodiment of the invention, using a starting material with transversely oriented fibres.

FIG. 4 shows one form of the processing unit 8 to which the strips 7 are fed by means of conveying wires 19 as described in said U.S. Pat. specification No. 4,017,345. The strips are liberated from the wires at a depositing roller 21, whereupon the processing unit 8 takes over conveyance and treatment of the strips 7. The processing unit 8 in this case comprises a vacuum drum 22 having a perforated cylindrical surface 23 serving as an intermediate supporting surface for the deposited strips 7, the latter being retained thereon by the suction force directed towards said cylindrical surface. The perforations of the cylindrical surface are sufficiently small to prevent the fibres from being sucked therethrough, and sufficient in number to enable the fibres to be retained on the cylindrical surface by means of the air flow sucked in at low pressure drop through the opening. By movement of the cylindrical surface 23 with the strips retained thereon the strips are passed under a screen 24 having juxtaposed parallel slots 26 inclined relatively to the spaces between the strips, each slot preferably covering more than one strip 7 on the cylindrical surface 23. Part of each slot 26 together with an adjacent slot covers a common area of the width of the web of material so that each strip 7 is subjected to the action of the air flow sucked in through at least two slots 26 as the web passes the screen 24. The treatment by means of the screen 24 results in some widening of the strips owing to the spreading effect of the air flow through the slots, so that the fibrous material becomes more homogeneous. Prior to deposition on a product receiving surface 27 the web may preferably pass a pressing or smoothing roller which urges the ends of the yarn lengths or fibres against the cylindrical surface 23, and the latter delivers the web to the product receiving surface 27 as the web leaves the zone of the cylindrical surface 23 subjected to vacuum. The product receiving surface 27 may be a conveyor belt or an adhesive carpet backing carried by a conveyor belt and to which one main surface of the web is caused to adhere.

Figure 5A:
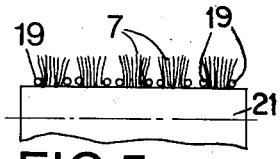
FIG. 5*a* is a section along the line I—I in FIG. 4, where the strips are still being held between conveying wires.
Figure 5B:
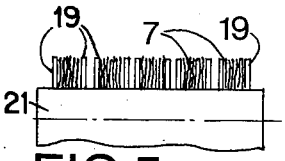
FIG. 5*b* is a similar view where the conveying wires have been replaces by conveying belts.

FIG. 5*a* shows a section of the web with the latter in contact with the roller 21, being retained thereon by means of the wires 19. FIG. 5*b* shows a similar section where the wires are replaces by belts 19, as in the U.S. Pat. specification No. 3,493,452. It will be seen that the wires or belts 19 may create smaller or greater longitudinal spaces between the strips 7.

Figure 6:
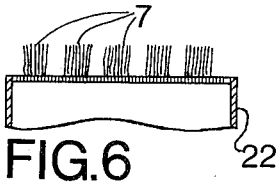
FIG. 6 is a section along the line II—II in FIG. 4.
Figure 7:
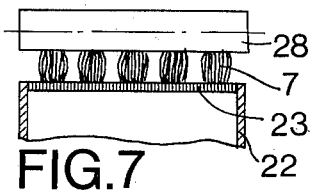
FIG. 7 is a section along the line II—II in FIG. 4 with the addition of a pressing roller.

When the strips 7 are deposited on the cylindrical surface 23 of the perforated vacuum drum 22, the said spaces remain to exist, as illustrated in FIG. 6, but are then gradually reduced as a result of the spreading effect produced by the air sucked towards the cylindrical surface 23, because the air flow passing through the spaces will have a higher velocity than that passing through the strips 7 so that a lower pressure will prevail in the spaces. Before the web arrives at the screen 24, the strips 7 may, as shown in FIG. 7, be subjected to a pressure applied by a pressing or smoothing roller 28, which in addition to smoothing the web also to some extent loosens the strip fibres.

Figure 8:
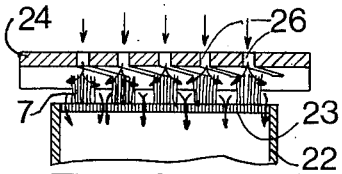
FIG. 8 is a section along the line III—III in FIG. 4.
Figure 9:
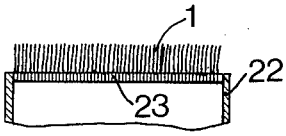
FIG. 9 is a section along the line IV—IV in FIG. 4.

The situation illustrated in FIG. 8 exists when the web is within the slot area of the screen 24, and it is indicated by arrows how air from the surroundings flows through the slots, is deflected transversely of the fibres and predominantly leaves the cylindrical surface 23 through the spaces between the strips 7. This transverse air flow loosens the fibres and spreads them towards the spaces between the strips until these spaces have been completely effaced as illustrated in FIG. 9 so as to render the fibrous material homogeneous.

Figure 10:
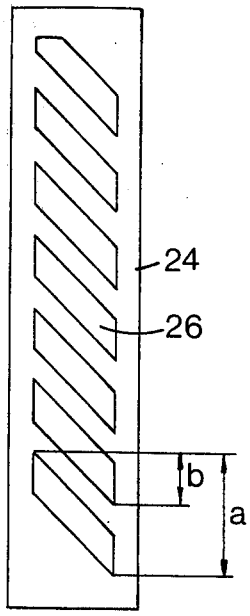
FIG. 10 is a facial view of a screen with slots forming part of the apparatus of FIG. 4.

FIG. 10 is an enlarged facial view of the screen illustrated in FIG. 4, and it will be seen that the slot width *a* as measured longitudinally of the screen overlaps the width of the adjacent slot over a length *b*. The screen 24 is shown in FIG. 4 as being curved to enable it to follow the surface of the web as the latter, carried by the cylindrical surface 23, passes the screen 24 at a distance preferably less than 10% of the thickness of the web. If a conveyor belt is used instead of the cylindrical surface 23, the screen 24 would have the configuration of the conveyor belt at the location of the screen with an increment to accomodate the thickness of the web at that location.

Figure 11:
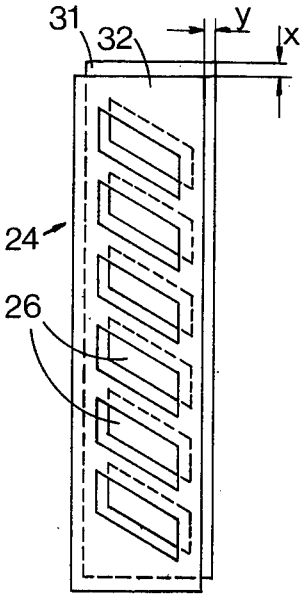
FIG. 11 shows a modified form of such a screen.

The screen 24 shown in FIG. 11 is composed of two screen parts 31 and 32 which are relatively movable as indicated at *x* and *y* and are arranged in closely spaced relationship, whereby the width, height and mutual spacing of the slots 26 may be varied. If the screen 24 as a whole is additionally movable transversely of the travelling direction of the web, also the location of the slots in relation to the strips may be varied.

Figure 13:
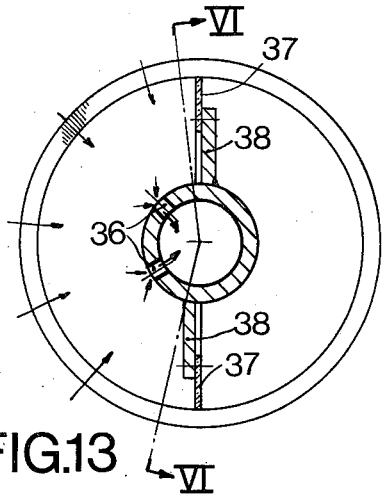
FIG. 13 is a section along the line V—V in FIG. 12.
Figure 12:
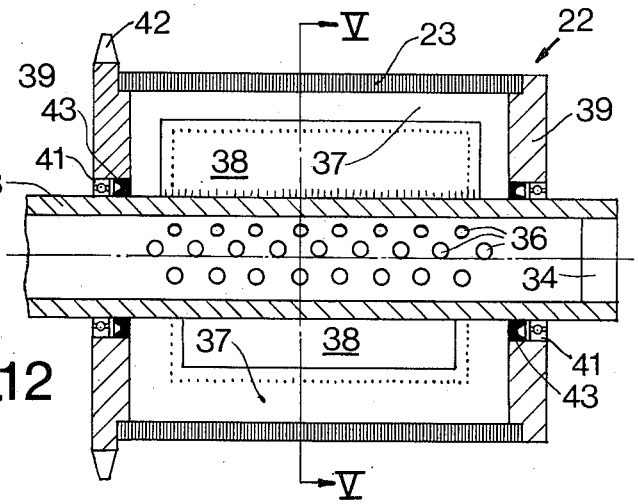
FIG. 12 is a section along the line VI—VI in FIG. 13 through a cylindrical intermediate supporting element forming part of the apparatus of FIG. 4.

FIG. 12 shows one constructional form of the vacuum drum 22 in a section taken along the line VI—VI of FIG. 13, while FIG. 13 is a crosssectional view taken along the line V—V of FIG. 12. The drum 22 is rotatably mounted on a stationary hollow shaft 33, one end of which is sealed by a stopper 34, while its opposite end is connected to a vacuum source, not shown, which via openings 36 in part of the shaft sucks air through the openings of the working part of the cylindrical surface 23, said part being defined by two sealing lips 37 each secured to a wing 38 fixed to the shaft 33 so that the shaft 33, the wings 38 and the sealing lips 37 combine to form, as indicated in FIG. 13, in one half of the interior of the drum 22, a vacuum chamber located between the two end walls 39 of the drum, both of which are mounted in bearings 41 on the shaft 33, one end wall being provided with a toothed rim 42 for rotating the drum. Furthermore, at the bearings 41 there are provided U-packings 43 to prevent leakage of air along the shaft 33. Naturally, the wings 38 need not, as shown, be arranged diametrically opposite to each other but may be otherwise arranged on the stationary shaft 33 depending on how much of the cylindrical surface 23 is intended to serve to convey the web of fibrous material from the first to the second depositing position.

Figure 14:
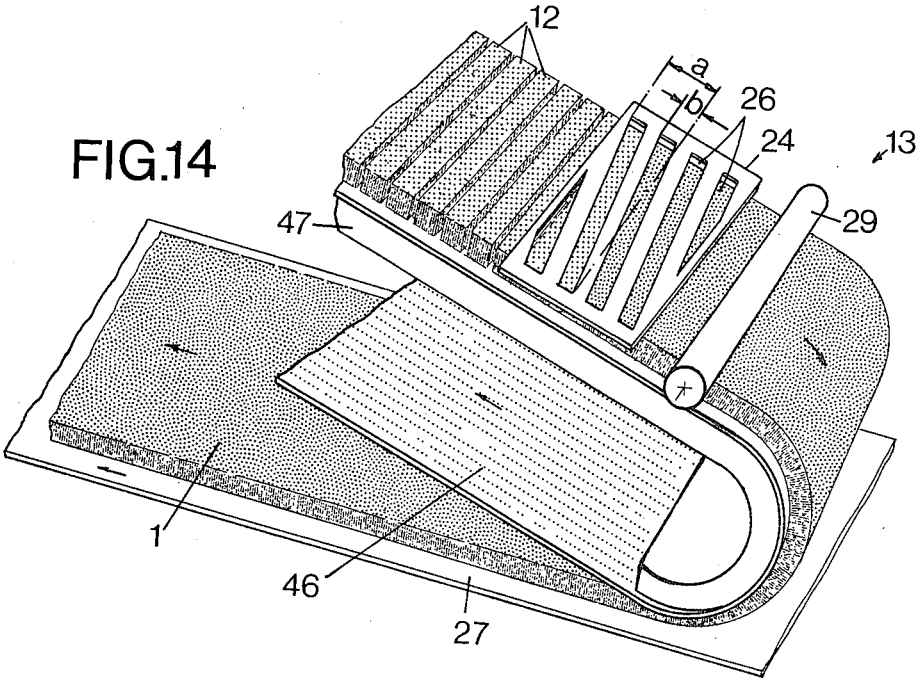
FIG. 14 is a perspective diagrammatic view of an apparatus according to a second embodiment of the invention, using a starting material with longitudinally oriented fibres.

FIG. 4 illustrates how the vacuum system is used when the strips 7 of the web material extend lengthwise of the travelling direction of the web material, and FIG. 14 shows how the vacuum system is used when the strips extend transversely of the travelling direction of the web material. The intermediary supporting surface in the latter case is a perforated conveyor belt 46, behind which a vacuum box 47 of U-shaped longitudinal section is arranged in sealing relationship to the belt 46 between the first and second depositing position. Also in this case the strips are treated by the air flowing through the slots 26 of the screen 24, and after said treatment the upstanding fibre ends may, if desired, be subjected to a light pressure applied by a pressure roller 29 prior to depositing the homogeneous web of fibrous material on the product receiving surface 27. The systems shown both in FIG. 4 and FIG. 14 are equally suitable for processing webs having transversely or longitudinally extending strips. The major distinction is the position of the slots 26 relatively to the longitudinal extension of the strips, the manner of feeding the strips to the intermediary supporting surface being nonessential for the principles of the process according to the invention. As the conveyor belt of FIG. 14 leaves the area of the vacuum box 47, the homogeneous web is released similarly as explained in connection with FIG. 4 from the conveyor belt and delivered to the product receiving surface 27.

Figure 15:
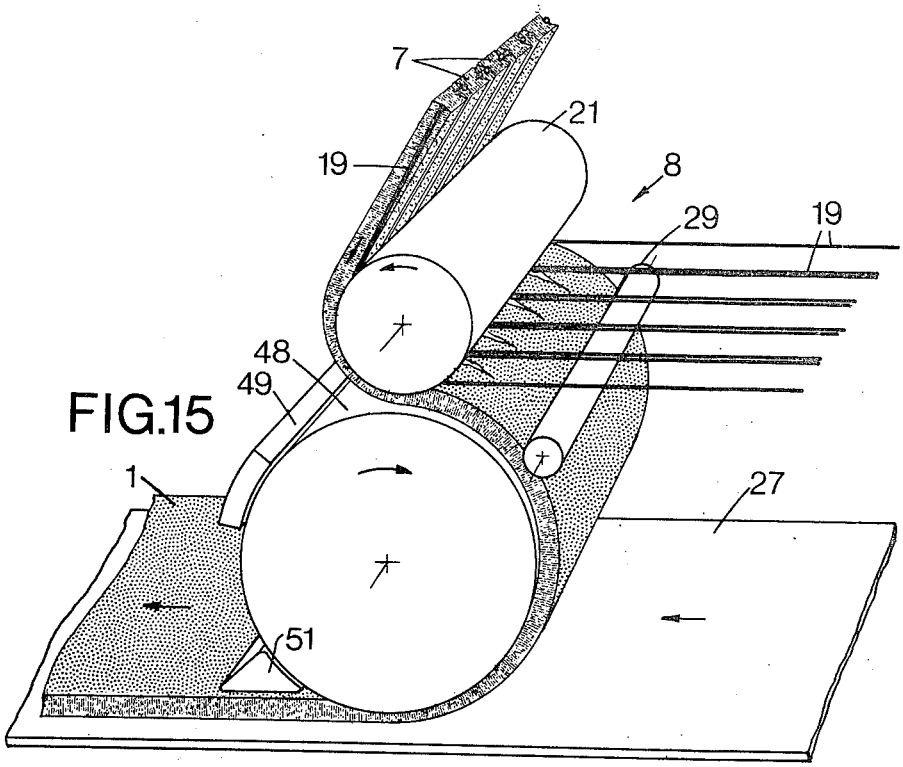
FIG. 15 is a perspective diagrammatic view of an apparatus according to a third embodiment of the invention where electrostatic forces are used for holding and spreading the fibres.

The attractive force required to retain the web material on the intermediary supporting surface may also be provided in some other manner, e.g. as illustrated in FIG. 15, where the intermediary supporting surface 48 is cylindrical and has at least one surface layor of electrically insulating material adapted to be electrostatically charged to enable the fibre ends of the strips deposited thereon to be electrostatically retained thereon, there being provided a means 49 for charging the supporting surface 48 prior to the deposition of the strips 7. The strips 7, like indicated in FIG. 4, are fed by means of wires 19 which leave the web of fibrous material at a roller 21 of a suitable material that will not prevent the electrostatic retention on the supporting surface 48. In case the supporting surface 48 is not a vacuum cylinder as shown in FIG. 4, the electrostatic charge by itself must be sufficient both to retain the fibres and to subject them to a spreading action towards the spaces between the strips, whereby the screen 24 can be omitted, as the electrostatic charge of the fibres themselves causes mutul repulsion, which repulsion will continue until the spaces between the strips 7 have been completely effaced, both at the outermost and innermost ends of the fibres, if the supporting surface 48 is sufficiently smooth to enable the mutual repulsive forces of the fibres to overcome the friction of the innermost fibre ends against displacement towards the spaces between the strips. The resultant homogeneous web of fibrous material may then be subjected to the action of a pressure roller 29 of a suitable material that will not remove the charge of the fibres or appreciably disturb the electrostatic field, and when the homogeneous web of fibrous material is to be deposited on the product receiving surface 27, the intermediate supporting surface 48 is subjected to an ionized atmosphere causing the surface to lose its electrostatic charge at the point of deposition and thereby also the attractive force retaining the web of fibrous material to enable the latter to be deposited on the product receiving surface 27. The discharge is effected by a discharge means 51 which, as stated, is capable of directing an ionized atmosphere against the intermediary supporting surface 48 and the fibre ends closest to that surface 48.

The electrically insulating material constituting the intermediary supporting surface 48 may also be of a nature such that after charging and conveyance of the fibres it is discharged to a conductive layer located radially within the surface 48 by rendering the latter conductive by exposure to light. Illustrative of such a material which becomes conductive by exposure to light within a certain range of wavelengths is selenium which, when not exposed to such electromagnetic radiation, behaves as a chargeable insulator but which by electromagnetic radiation at certain wavelengths becomes conductive, whereby any charge may be dissipated. Among other materials suitable for the intermediary supporting surface 48 could be mentioned plastic and rubber which are capable of being charged, retaining the charge and being discharged when desired. The voltages used for retaining the fibres on the intermediary supporting surface 48 by electrostatic effect alone are of the order of several thousands volts, and this principle of retaining and conveying fibres is at least suitable for strip heights of the order of from 20 to 30 mm. The electrostatic principle has the effect that the strips 7, when delivered to the supporting surface 48, are retained at one of their main surfaces, the fibres being charged to a potential opposite to that of the intermediate supporting surface 48, which charge, beyond retaining the fibres, has the effect that the fibres are mutually repulsed by their own charge so as to assume a uniform distribution on the intermediary supporting surface. This effaces the spaces between the strips, merging these into a homogeneous web of fibrous material which is delivered to the product receiving surface 27 by discharging the intermediate supporting surface or reversing its potential at the second depositing position where the product receiving surface, which may be provided with an adhesive layer and a supporting layer, enters into contact with the second main surface of the web of fibrous material.

We claim:

1. A process for the continuous production of a fibrous web-like pile product consisting of fibers oriented substantially at right angles to the two main surfaces of the web, starting from a primary fibrous web in which the fibers are oriented substantially along the main surfaces of the web either transversely or longitudinally of the web, comprising the steps of cutting the primary web into strips consisting of cut-off fibers, arranging the strips side by side with the cut-off fibers standing on end and conveying them in this side-by-side relationship to a first depositing position, depositing the strips in the first depositing position onto a moving intermediary supporting arcuate surface having perforations, sucking air through said perforations by creating a vacuum on the side of said intermediary supporting surface facing away from the strips, thereby creating on the strips an attractive force sufficient to hold them attached thereto while being inverted by the supporting surface, at the same time guiding the afflux of air to the intermediary supporting surface through the web formed by the strips at least over part of the travel of the latter on the intermediary supporting surface in such a manner as to subject the fibers forming the strips to a spreading effect transversely of the strips, and thereafter depositing the fibers in inverted position at a second depositing position onto a moving product receiving surface while at the same time interrupting the suction acting on the fibers being deposited.

2. A process as in claim 1, characterized in that said guiding of the afflux of air is effected by means of slots of a screen arranged immediately outside the outermost fiber ends.

3. A process as in claim 2, characterized by so arranging the slots that a substantial part of the air drawn through same is caused to flow into the bodies of the strips and to be deflected therein towards the strip edges from where it is drawn through the perforations of the intermediate supporting arcuate surface.

4. An apparatus for the continuous production of a fibrous web-like pile product consisting of fibers oriented substantially at right angles to the two main surfaces of the web, starting from a primary fibrous web in which the fibers are oriented substantially along the main surfaces of the web either transversely or longitudinally of the web, said apparatus comprising means for cutting the primary web into strips consisting of cut-off fibers, arranging the strips side by side with the cut-off fibers standing on end and conveying them in this side-by-side relationship to a first depositing position, characterized in that it comprises a movable element constituting a perforated intermediate supporting arcuate surface arranged to receive said strips in said first depositing position and to convey them to a second depositing position for deposition in inverted position on a moving product receiving surface, means active between said first and second depositing positions for producing an attractive force acting on the strips in a direction towards said intermediate supporting surface to retain the strips thereon and for subjecting the fibers of the strips to a spreading action directed towards the spaces between the strips while said strips are being inverted by said supporting surface.

5. An apparatus as in claim 4, the intermediary supporting arcuate surface being in communication, throughout its width and over the part of its length between the first and the second depositing positions, with a vacuum chamber provided behind the intermediary supporting surface via a plurality of openings extending through the supporting surface over its entire area, which openings are sufficiently small to prevent the fibers from being sucked therethrough and sufficient in number to enable the fibers to be retained on the supporting surface by means of the air flow sucked in at a low pressure drop through the openings, means being provided for guiding the afflux of air to the intermediary supporting surface through the web formed by the strips at least over part of the travel of the latter from the first to the second depositing position in such a manner as to subject the fibers forming the strips to a spreading effect transversely of the strips.

6. An apparatus as in claim 5, characterized in that the means for guiding the afflux of air comprise a screen mounted at a distance from the intermediary supporting surface and having air passage slots arranged with equal spacing transversely of the strips, the distance of said screen from the intermediary supporting surface being preferably less than 10% greater than the thickness of the strips.

7. An apparatus as in claim 6, characterized in that the slots are inclined relatively to the longitudinal direction of the strips, each slot covering more than one fiber strip on the intermediary supporting surface, at least part of each slot together with at least part of an adjacent slot covering a common area of the width of the web formed by the strips.

8. An apparatus as in claim 7, characterized in that the screen comprises two overlapping, closely spaced, relatively adjustable parts, each provided with slots capable of being aligned with the slots of the other part to provide a full flow area and of being displaced relatively to the slots of the other part to reduce the flow area.

9. An apparatus as in claim 4, characterized in that the intermediary supporting surface is cylindrical and is rotatably mounted on a stationary hollow shaft provided with sealing lips in positions corresponding to the first and second depositing positions and having openings for producing a vacuum along the portion of the supporting arcuate surface at any time travelling from the first to the second depositing position.

* * * * *